United States Patent [19]

Kobayashi

[11] Patent Number: 4,981,059

[45] Date of Patent: Jan. 1, 1991

[54] CUTTING MECHANISM CONTROL FOR DOT MATRIX PRINTER

[75] Inventor: Takemi Kobayashi, Hiratsuka, Japan

[73] Assignee: NCR Corporation, Dayton, Ohio

[21] Appl. No.: 384,198

[22] Filed: Jul. 24, 1989

[30] Foreign Application Priority Data

Sep. 16, 1988 [JP] Japan ..... 63-230162

[51] Int. Cl.[5] ..... B26D 5/02

[52] U.S. Cl. ..... 83/76.7; 83/248; 83/484; 83/485; 83/508; 83/614; 400/621

[58] Field of Search ..... 83/62, 74, 69, 524, 83/563, 484, 485, 614, 508, 578, 248, 76.7, 76.6, 76.1; 400/621; 101/93.07

[56] References Cited

U.S. PATENT DOCUMENTS

| | | | |
|---|---|---|---|
| 3,805,652 | 4/1974 | LaLonde et al. | 83/614 X |
| 4,152,962 | 5/1979 | Hendrischk | 83/482 |
| 4,504,162 | 3/1985 | Speraggi | 400/621 |
| 4,516,493 | 5/1985 | Schemenauer | 83/248 X |
| 4,604,632 | 8/1986 | Matsumoto | 101/93.07 X |
| 4,665,787 | 5/1987 | Arnold et al. | 83/485 |
| 4,701,063 | 10/1987 | Wysk et al. | 83/483 X |
| 4,779,500 | 10/1988 | Bennett et al. | 83/614 X |

*Primary Examiner*—Hien H. Phan
*Assistant Examiner*—Rinaldi Rada
*Attorney, Agent, or Firm*—Wilbert Hawk, Jr.; Albert L. Sessler, Jr.; George J. Muckenthaler

[57] ABSTRACT

A control mechanism for a record media cutting blade has a carriage for moving the cutting blade from a home position to a record media cutting position. The carriage has a photosensor secured thereto and is operably associated with a first reflecting member at the home position of the carriage and with a second reflecting member at the record media cutting position of the carriage. The second reflecting member is operably associated with the photosensor for partial cut or for full cut of the record media by the cutting blade. The movement of the carriage is controlled by the output of the photosensor to a comparator, to a converter and to a central processing unit.

13 Claims, 12 Drawing Sheets

IS SENSOR DIGITAL OUTPUT "0" → "1" ?
120
N
Y
IS SENSOR ANALOG OUTPUT $V_2$ ?
122
N
CORRECT ERROR
130
Y
IS SENSOR DIGITAL OUTPUT "0" → "1" ?
124
N
Y
STOP ROUND BLADE
126
IS SENSOR ANALOG OUTPUT $V_1$ ?
128
N
CORRECT ERROR
132
Y
END

CUTTING MECHANISM CONTROL FOR DOT MATRIX PRINTER

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like record media while the carriage and print head are moved above and across the form or like record media in the horizontal direction.

Further, in the wire matrix printer which is utilized for receipt, slip and journal printing operations, the individual print heads may be vertically oriented and printing performed by means of the print wires moving downwardly to impact on the record media. Alternatively, the individual print heads may be horizontally oriented and printing performed by means of the print wires moving horizontally to impact on the record media. A preferred number of four of such individual print heads is common in known arrangements. The dot matrix printer is commonly used in an electronic cash register (ECR) or in a point of sale (POS) terminal.

In the dot matrix printer, there is a requirement for one or more small electric motors to drive certain parts of the printer. A small motor is used to drive the print head carriage in reciprocating manner in the printer that includes a stationary platen and a movable print head. The print head carriage and the associated print head are moved to appropriate and precise locations along the line of printing for dot matrix printing of alpha numeric characters or of graphics type characters. A second motor is used to drive the paper such as a receipt, a slip or a journal at the end of the printing operation and which paper drive is usually performed at the end of each line of printing. However, it is feasible to advance the paper at the end of the printing on a line without the necessity of moving the carriage and print head to the end of such line. This arrangement enables faster printing operation.

Additionally, in the dot matrix printer which is used for receipt, slip and journal printing operations, the receipt paper from a supply roll thereof is cut after each receipt printing operation and a receipt is given to the customer. The device for cutting the receipt paper has commonly been a tool, a blade or a cutter wheel.

Representative documentation in the field of dot matrix printers includes W. Hendrischk U.S. Pat. No. 4,152,962, issued on May 8, 1979, which discloses a cutter roll having a small diameter portion and a large diameter portion providing a spaced cutting operation.

M. Speraggi U.S. Pat. No. 4,504,162, issued on Mar. 12, 1985, discloses a rotary cutter mounted on a rockable lever that is spring biased from the platen and actuated to a cutting position.

S. E. Arnold et al. U.S. Pat. No. 4,665,787, issued on May 19, 1987, discloses an axially spring-loaded cutting wheel mounted on a pivotable carrier to provide automatic adjustment of the wheel at an angle in both directions of travel.

H. J. Wysk et al. U.S. Pat. No. 4,701,063, issued on Oct. 20, 1987, discloses a rotary cutter mounted on a printing trolley and a control mechanism for actuating the cutter between cutting and non-cutting positions with a spring biasing the cutter.

Summary of the Invention

The present invention relates to dot matrix printers and is directed to a dot matrix printer of compact size for impact printing on record media and including a plurality of printing stations. The plurality of printing stations are used in an electronic cash register (ECR) or a point of sale (POS) terminal for printing on two or more record media. More particularly, the invention is directed to a two station printer, one station being positioned near the front of the printer and utilized for dot matrix printing on a receipt and a slip. The second station is positioned near the rear of the printer and is utilized for dot matrix printing on a journal. The two stations are disposed relative to each other in tandem manner and the print head carriages (front and rear) are driven by a single drum type cam common to and positioned between the two carriages. The two carriages along with the associated print heads are driven by the drum type cam an equal distance in opposite directions during printing operations. The one station near the front of the printer is referred to as the receipt/slip printing station and the other station rearwardly of the one station is referred to as the journal printing station.

The receipt/slip printing station includes six, single wire solenoids, aligned across and supported by the front carriage. The solenoids are vertically oriented for printing downwardly on receipt paper or on a slip disposed on a fixed platen.

The journal printing station also includes six, single wire solenoids, aligned across and supported by the rear carriage. The solenoids are horizontally oriented for printing in the rearward direction against journal paper driven past a fixed platen.

The single drum type cam drive is positioned between the receipt/slip station and the journal station. The drum cam includes a rail on the periphery thereof which engages with a pair of rollers on each print head carriage. Rotation of the drum cam in a predetermined direction causes the receipt/slip print head carriage to move in one direction across the printer and causes the journal print head carriage to move an equal distance in the opposite direction.

A receipt paper roll is disposed rearwardly and downwardly of the receipt/slip station and receipt paper is driven across the platen for printing on the paper. A knife mechanism is provided at the front of the printer for cutting the receipt paper after printing thereon. The printer also includes a slip table positioned for receiving a slip for printing thereof at the receipt/-slip station.

In accordance with the present invention, there is provided a dot matrix printer comprising spaced side frames, a cutting mechanism movable across the printer for cutting receipt paper, means for driving the cutting mechanism in reciprocating manner across the printer, and control means for controlling the movement of the cutting mechanism including a photosensor of a reflecting type having a light emitting element carried on the cutting mechanism, a first light reflecting plate at one position and spaced from the photosensor at a predetermined first distance therefrom when the cutting mechanism is at the home position, a second light reflecting plate at another position and spaced from the photosensor at a predetermined second distance therefrom when the cutting mechanism is at a second position, the second distance being different from the first distance and output signals being generated in accordance with said first distance and said second distance, means for sensing a difference in the light received by the photosensor at the two distances, and means responsive to the difference in light received by the photosensor for controlling the cutting mechanism driving means.

In view of the above discussion, a principal object of the present invention is to provide an improved cutting mechanism for a dot matrix printer.

Another object of the present invention is to provide a cutting mechanism having control means for recognizing the position of the mechanism along the line of printing.

An additional object of the present invention is to provide control means for a cutting mechanism that recognizes a home position and a cutting position.

A further object of the present invention is to provide sensing means for a cutting mechanism that uses reflective plates at different distances from a moving sensor to recognize the position of the cutting mechanism.

Additional advantages and features of the present invention will become apparent and fully understood from a reading of the following description taken together with the annexed drawing.

DESCRIPTION OF THE PREFERRED EMBODIMENT

Figure 1:
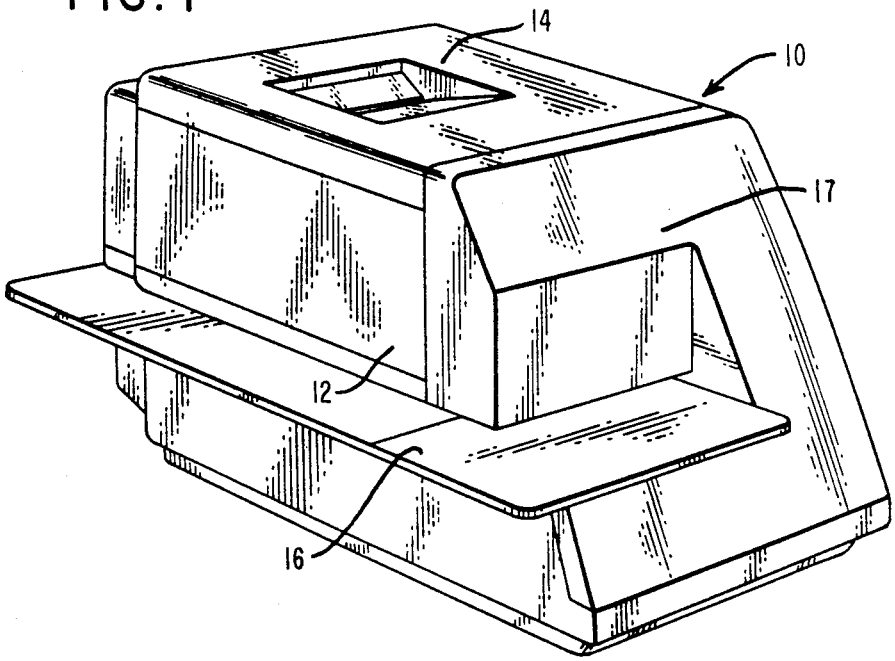
FIG. 1 is a perspective view of a dot matrix printer incorporating the subject matter of the present invention.

Referring now to FIG. 1, a printer 10 is designed as a two station, receipt/slip and journal printer. The receipt/slip printing station occupies a front portion 12 and the journal printing station occupies a rearward portion 14 of the printer. A slip table 16 is provided along the left hand side of the printer 10. A front cover 17 swings toward the right to expose certain operating parts of the printer 10.

Figure 2:
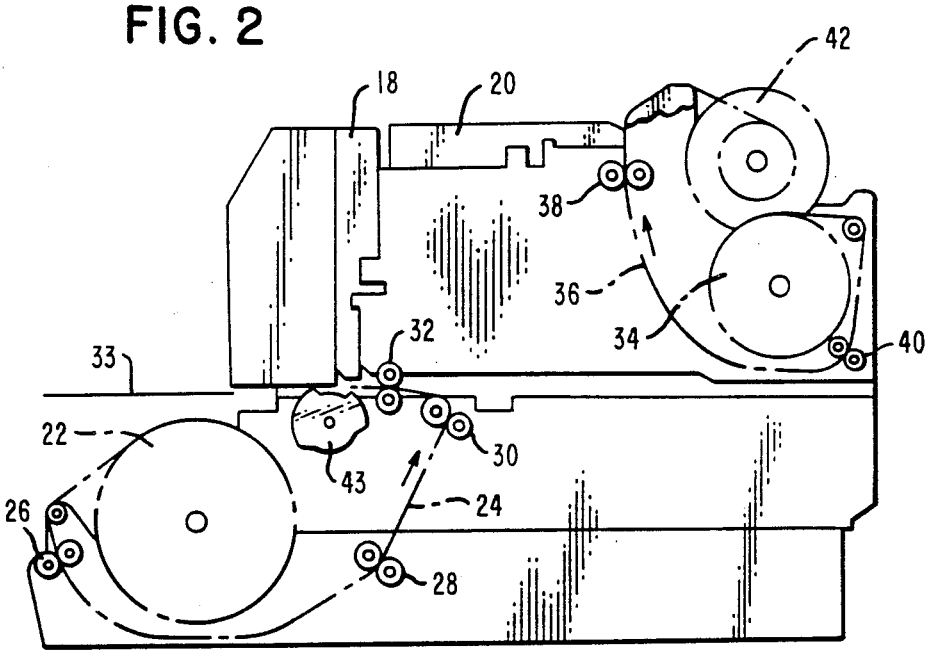
FIG. 2 is a right side elevational view in diagrammatic form showing the arrangement of certain elements of the printer.
Figure 3:
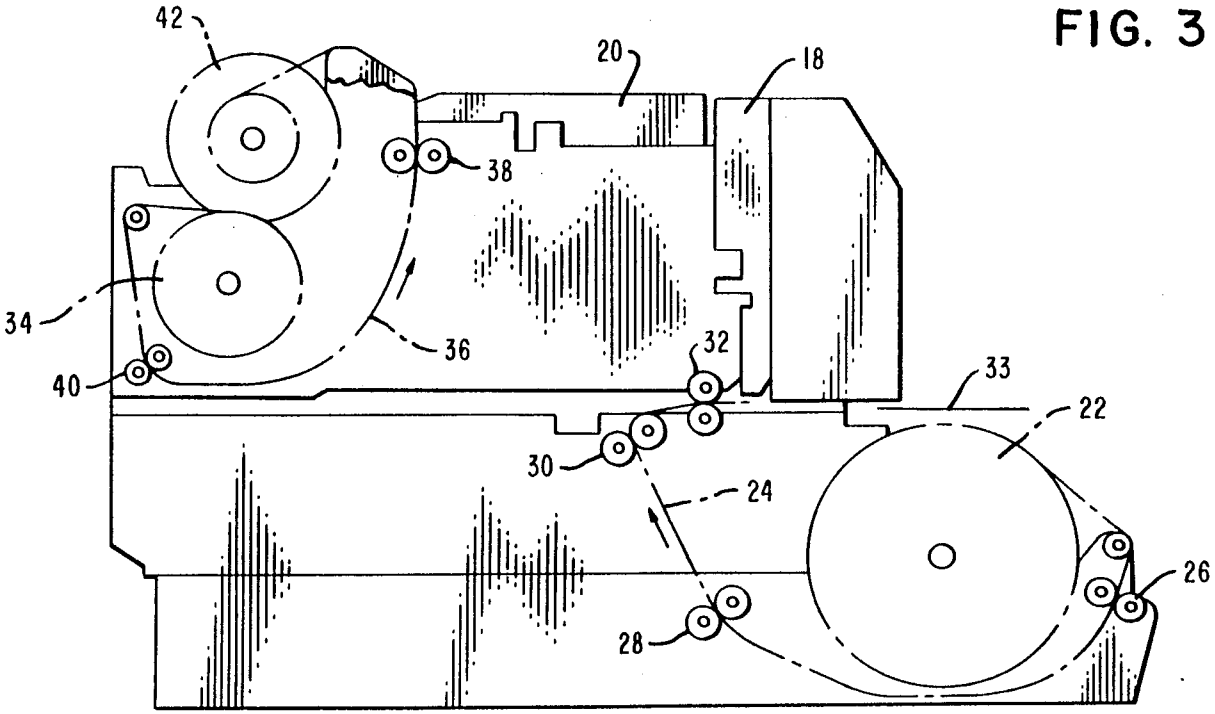
FIG. 3 is a left side elevational view in diagrammatic form showing the arrangement of such certain elements of the printer.

FIGS. 2 and 3 are right and left side elevational views and show certain elements of the printer 10 in diagrammatic form. The receipt/slip portion 12 and the journal portion 14 include individual print wire solenoids (not shown) along with a ribbon cassette 18 for the receipt/-slip printing operation and a ribbon cassette 20 for the journal printing operation. A roll 22 of receipt paper is journaled at the front of the printer 10 and the receipt paper 24 is driven and guided by appropriate pairs of rollers, as 26, 28, 30 and 32 in a path past the receipt/slip printing station for printing operation and for issuance of a receipt 33 after cutting thereof from the receipt paper 24. A supply roll 34 of journal paper is positioned in a cradle at the rear of the printer 10 and the journal paper 36 is driven and guided by appropriate pairs of rollers, as 38 and 40, in a path from the supply roll 34, past the journal printing station, and onto a take-up roll 42. A timing plate 43 (FIG. 2) is provided at the receipt/slip printing station for positioning the receipt/-slip feed rolls.

Figure 4:
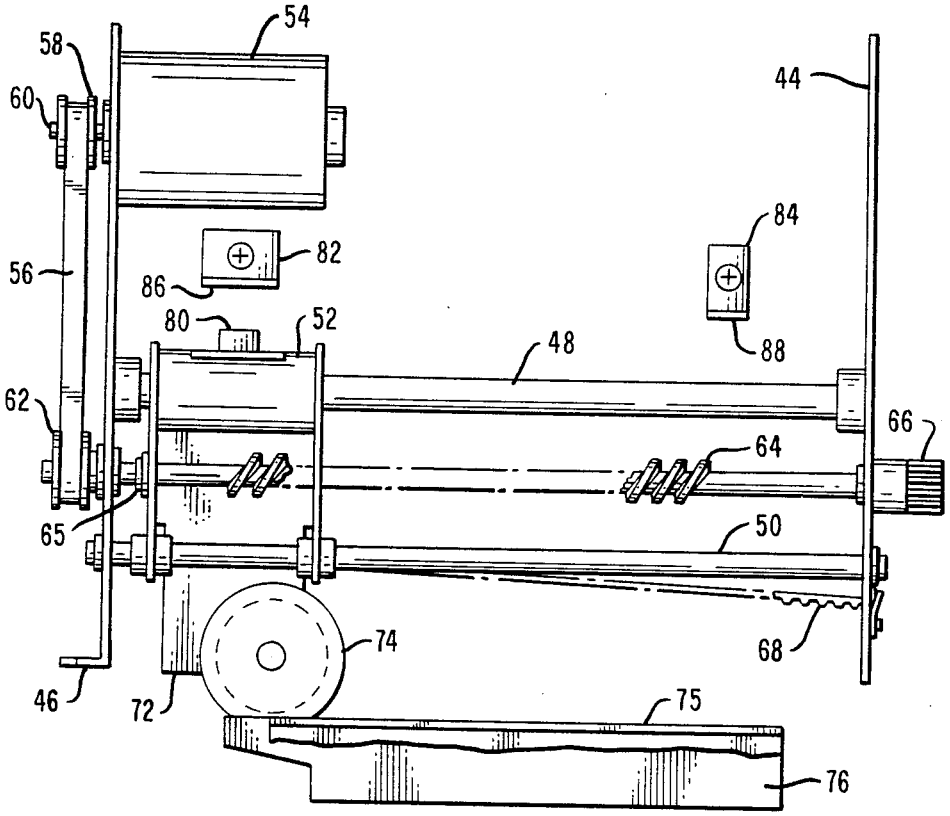
FIG. 4 is an elevational view showing the arrangement of the cutting mechanism and the photosensor with the reflecting elements.
Figure 5:
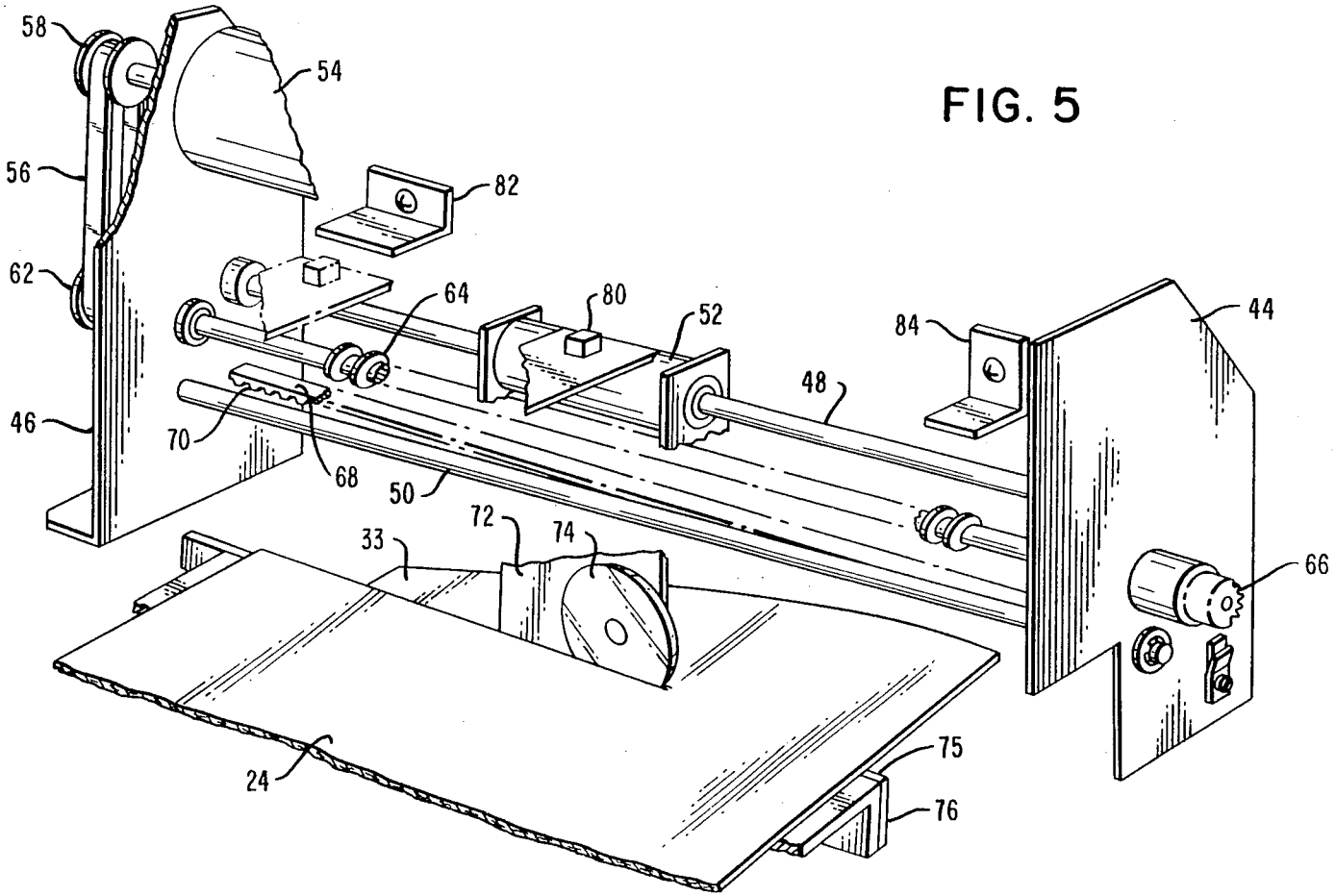
FIG. 5 is a perspective view of a preferred embodiment of the structure shown in FIG. 4.

FIG. 4 is an elevational view and FIG. 5 is a perspective view of the receipt cutting mechanism according to a preferred embodiment of the present invention. Prior to describing the invention in detail, it is convenient to mention certain aspects of a receipt cutting operation. A first check in such operation is made as to whether or not the carriage for the cutting knife or blade is at the home position. If the carriage is not at the home position, the control mechanism or other means moves the carriage to such home position. After a printing operation is completed, the carriage is moved or driven to the cutting position to cut a receipt from the receipt paper. The cutting operation may be one of partial cut or full cut dependent upon the desires or requirements of the business. At the completion of the cutting operation, the carriage is returned to the home position.

Referring now to FIG. 4, a right side plate 44 and a left side plate 46 provide support for the receipt cutting mechanism. The right side and the left side notations are provided for description of the arrangements illustrated in FIGS. 4 and 5. A pair of shafts 48 and 50 are secured to the side plates 44 and 46 and provide support for a carriage 52 that is slidably moved along the shafts 48 and 50 in transverse direction on the printer 10. The carriage 52 is driven in such transverse direction by means of a reversing-type motor 54 which is suitably supported by the left side plate 46. A toothed belt 56 is trained around a pulley 58 on the end of a motor shaft 60 and around a pulley 62 on the end of a lead screw-type drive shaft 64. The drive shaft 64 is coupled by means of a threaded hub 65 associated with the carriage 52 for driving thereof across the printer 10. A knob 66 is secured to the end of the shaft 64 to be used for turning the shaft in case of a jam or for manually moving the carriage 52 to a desired position.

A belt or like resilient member 68 (FIG. 5) with teeth 70 is stretched across the printer parallel to the shafts 48 and 50 and is secured to the side plates 44 and 46 by suitable means. A bracket 72 provides support for drive mechanism associated with the lead screw drive shaft 64 for driving the carriage 52 across the printer 10. A detailed description of such carriage drive mechanism is disclosed in copending application Ser. No. 385,338, filed July 24, 1989.

A circular cutting knife or blade 74 is rotatably carried by the bracket 72 of the carriage 52 and is operably associated with a knife edge 75 of a fixed blade 76. The fixed blade 76 is suitably secured to structure between the side plates 44 and 46 of the printer 10. Rotation of the cutting blade 74 along the knife edge 75 of the fixed blade 76 operates to cut a receipt 33 from the receipt paper 24 (FIG. 5).

A light reflecting type photosensor 80 is positioned above and secured to the top of the carriage 52 and is operably associated with a first light reflective plate 82 positioned in the home position of the carriage 52 and is operably associated with a second light reflective plate 84 positioned in the cutting position of the carriage 52. The photosensor 80 includes a light emitting element (not shown) facing the reflective plates 82 and 84. The plate 82 has a reflecting face or surface 86 (FIG. 4) opposed to the photosensor 80 and the plate 84 has a reflecting face or surface 88 also opposed to the photosensor 80.

Figure 6A:
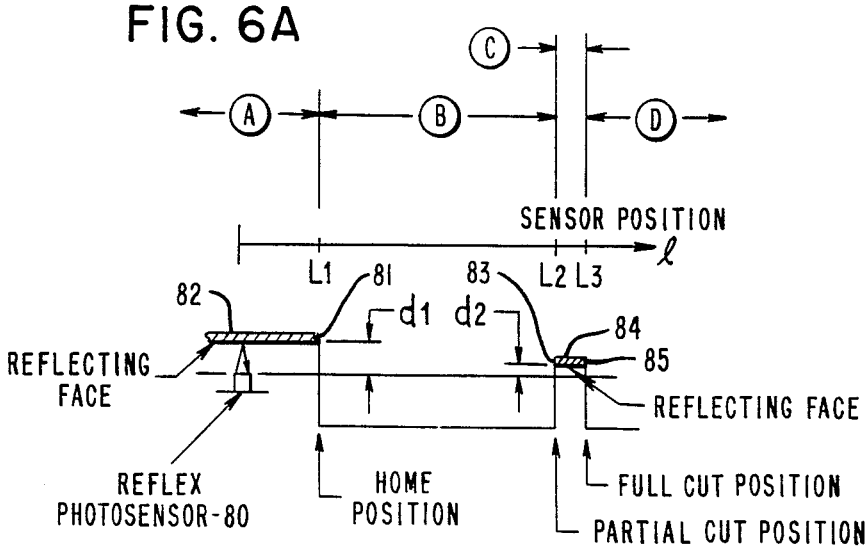
FIGS. 6A, 6B and 6C are diagrams showing the relationship between the positions of the reflecting elements and the magnitudes of the output voltages of the photosensor.
Figure 6B:
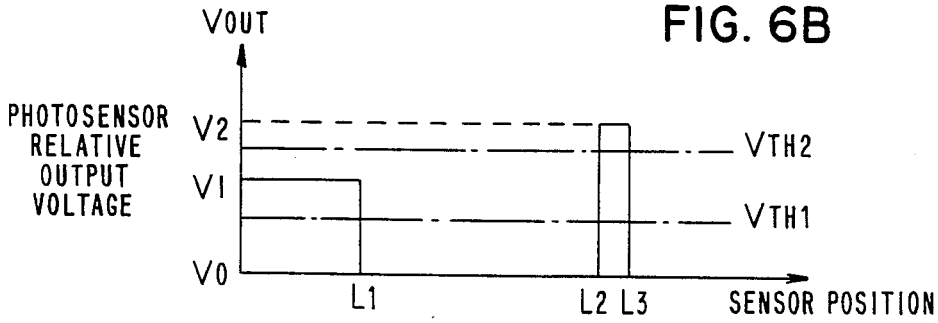
Figure 6C:
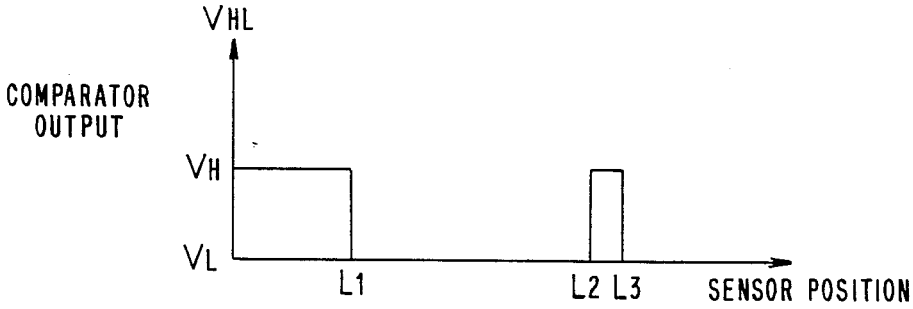

FIGS. 6A, 6B and 6C show the relationship between the positions of the reflective plates 82 and 84 and the magnitudes of the output voltages of the photosensor 80. The reflective plate 82 is positioned at a distance $d_1$ of four millimeters from the face of the photosensor 80 and the reflective plate 84 is positioned at a distance $d_2$ of two millimeters from the face of the photosensor 80. Since the photosensor 80 is mounted on the carriage 52 and moves therewith across the printer 10, the photosensor 80 scans the reflecting surface 86 (FIG. 4) of the plate 82 and scans the reflecting surface 88 (FIG. 4) of the plate 84. As seen in FIG. 6A, the first light reflective plate 82 includes an edge 81 with the home position of the carriage 52 being represented at edge 81 or location $L_1$. The letter A in the circle in FIG. 6A represents a section of the path of the carriage 52 from a start position at the left side of the printer 10 to the home position of the carriage 52 and the cutting blade 74K. The output voltage of the photosensor 80 is $V_1$ in this section of the path of the carriage 52 (FIG. 6B). The second light reflective plate 84 includes one edge 83 thereof representing the location of a partial cut position or location $L_2$ and another edge 85 thereof representing the location of a full cut position or location $L_3$ of the carriage 52 and the cutting blade 74. The cutting operation for partial cut of the receipt paper 24 takes place from edge 81 of reflective plate 82 to edge 83 of reflective plate 84. The letter B in the circle in FIG. 6A represents a section of the path or the distance covered by the cutting blade 74 for a partial cut of the receipt paper 24. The output voltage of the photosensor 80 is $V_0$ in this section of the path of the cutting blade 74 (FIG. 6B). The cutting operation for full cut of the receipt paper 24 takes place from edge 81 of reflective plate 82 to edge 85 of reflective plate 84. The letter C in the circle in FIG. 6A represents a section of the path or the additional distance covered by the cutting blade 74 for a full cut of the receipt paper 24. The output voltage of the photosensor 80 is $V_2$ in this section of the path of the cutting blade 74 (FIG. 6B). The letter D in the circle represents a section of the path of the cutting blade 74 from the full cut position to an end position of the carriage and the cutting blade. In this section of the path of the carriage 52 and the cutting blade 74 across the printer 10, the output voltage of the photosensor 80 is $V_0$. The edges 81, 83 and 85 provide photosensor read locations for output voltages.

Figure 7A:
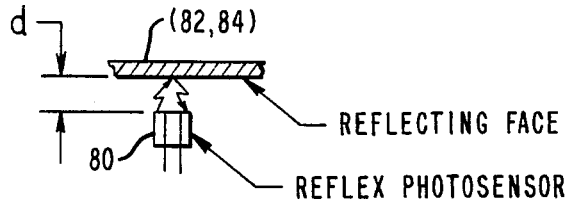
FIGS. 7A and 7B are diagrams showing the relationship between the photosensor and the magnitudes of the voltages of the photosensor in two positions thereof.
Figure 7B:
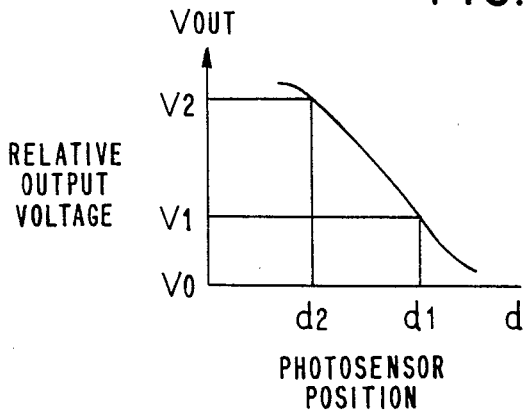

FIGS. 7A and 7B show the relationship between the photosensor 80 and the magnitude of the output voltages in the two positions of the photosensor 80. In the arrangement of the reflective plates 82 and 84, as shown in FIGS. 4 and 6A, the voltage signal detected by the photosensor 80 is proportional to the amount of light received by the light receiving element of the photosensor 80 after reflection of the light emitted by the light emitting element of the photosensor 80 off the surface of the respective reflective plate 82 or 84. The photosensor 80 detects the reflective output voltage $V_1$ in the home position of the carriage 52 and the reflective output voltage $V_2$ in the cutting position, as shown in FIG. 7B, wherein output voltage $V_1$ is indicated as being less than output voltage $V_2$. FIG. 7A illustrates a variable distance d between a photosensor 80 and a reflecting plate (82 or 84) and FIG. 7B shows a variation in the relative output voltage ($V_2$ greater than $V_1$) in accordance with the change in the distance d at the respective locations when the photosensor 80 is moved horizontally across the printer 10. The higher output voltage $V_2$ is generated by the greater amount of light reflected through the lesser distance d2 from the reflective plate 84 (FIG. 6A).

Referring back to FIGS. 6A, 6B, and 6C, a threshold voltage, designated as $V_{TH1}$ (FIG. 6B), is always lower than output voltage $V_1$ and is higher than a voltage $V_0$, the latter being the case wherein no reflection plate is in the path of the light emitted from the photosensor 80.

$V_0$ in FIGS. 6B and 7B represents a zero output voltage of the photosensor 80 when a reflection plate 82 or 83 is not present and the sensor 80 does not see a reflection plate. A threshold voltage, designated as $V_{TH2}$ (FIG. 6B), is always higher than output voltage $V_1$ and is lower than output voltage $V_2$. Accordingly, when the output voltage $V_{OUT}$ of the photosensor 80 is lower than threshold voltage $V_{TH1}$, the cutting blade 74 is in an intermediate position between the home position or location $L_1$ and the cutting position or location $L_2$ or $L_3$. It is further noted that when the output voltage $V_{OUT}$ is at a value between threshold voltage $V_{TH1}$ and threshold voltage $V_{TH2}$, the cutting blade 74 is in the home position, and when the output voltage $V_{OUT}$ is higher than threshold $V_{TH2}$, the cutting blade 74 is in the cutting position. In an alternative arrangement, a similar effect and result can be obtained when the light reflective characteristics of the reflective plates 82 and 84 are different from each other rather than having the distances $d_1$ and $d_2$ different. FIG. 6B shows such relationship between the output voltage $V_{OUT}$ of the photosensor 80 and the threshold voltages $V_{TH1}$ and $V_{TH2}$.

FIG. 6C shows the relationship between the photosensor 80 and the position of the cutting blade 74 wherein a high digital output $V_H$ is generated when the blade 74 is in the position of either one of the reflective plates 82 or 84. It is seen from FIG. 6A that the photosensor 80 receives a reflected signal from the face 86 of the reflective plate 82, and that the photosensor 80 does not receive a reflected signal, indicated at $V_L$, from the time of passing edge 81 of the plate 82 until the photosensor 80 sees the edge 83 of the reflective plate 84. The photosensor 80 receives a reflected signal from the face 88 of the reflective plate 84 at the time of passing edge 83 thereof indicating a partial cut position of the cutting blade 74 on the carriage 52 and at the time of passing edge 85 of the reflective plate 84 indicating a full cut position.

Figure 8:
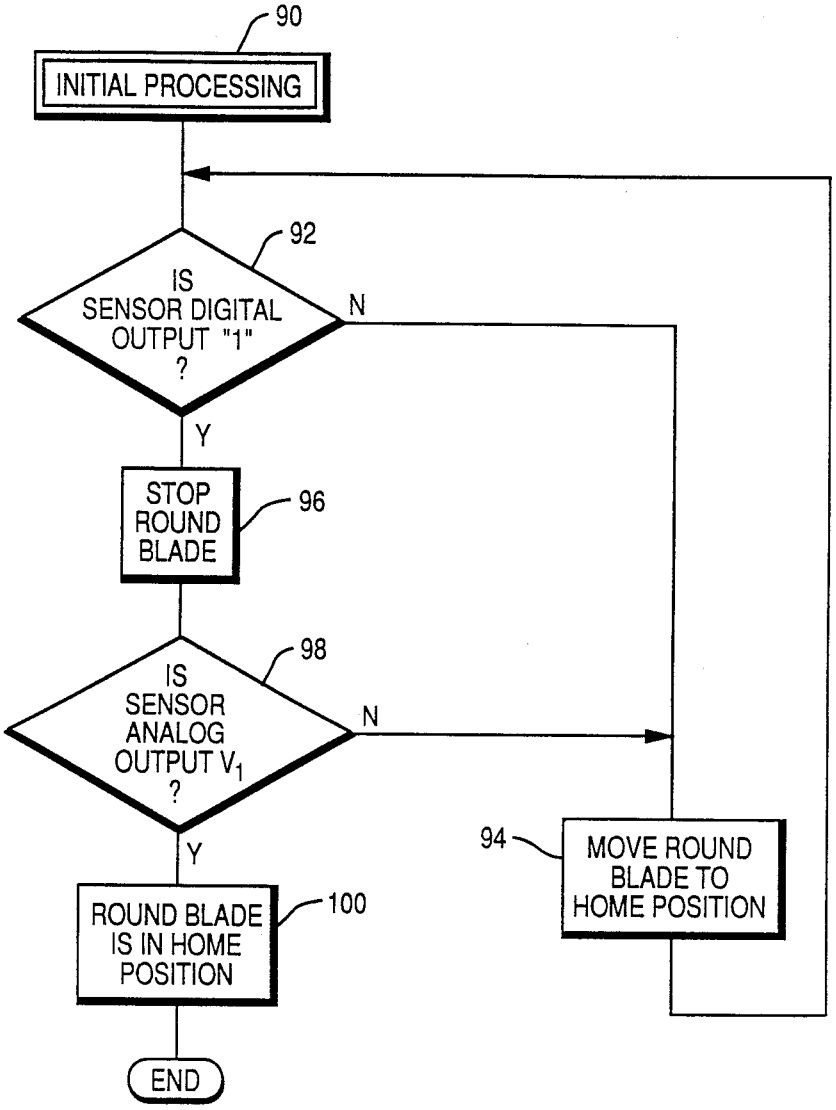
FIGS. 8, 9A, 9B and 10, taken together, constitute a flow chart of instructions for controlling the movement of the cutting mechanism.

The processing of the output voltage of the photosensor 80 as detected by signals from the reflective plates 82 and 84 in the control system of the present invention is illustrated in the flow charts of FIGS. 8, 9A, 9B and 10. FIG. 8 shows the initial processing steps, as started at block 90, when the printer 10 is turned on for printing operation. When the digital output of the photosensor 80 is "0" or low level, the cutting blade 74 is not in the home position, so the process makes a decision as to the logic level and goes through the steps of block 92 and of block 94 to move the cutting blade to the home position. When the digital output of the sensor 80 is "1" or high level, the process makes a decision and goes through step 92 and the motion of the cutting blade 74 is stopped (block 96). The level of the output voltage $V_{OUT}$ (FIG. 6B) of the photosensor 80 (hereafter sensor analog output) is determined and the process makes a decision regarding such sensor analog output (block 98). If the sensor analog output ($V_{OUT}$) is of the value of $V_1$ in the home position, the cutting blade 74 is not moved as the blade 74 is indicated as already being in the home position (block 100). If the sensor analog output ($V_{OUT}$) is of the value of $V_2$ in the cutting position, the cutting blade 74 is moved to the home position (block 94).

Figure 9A:
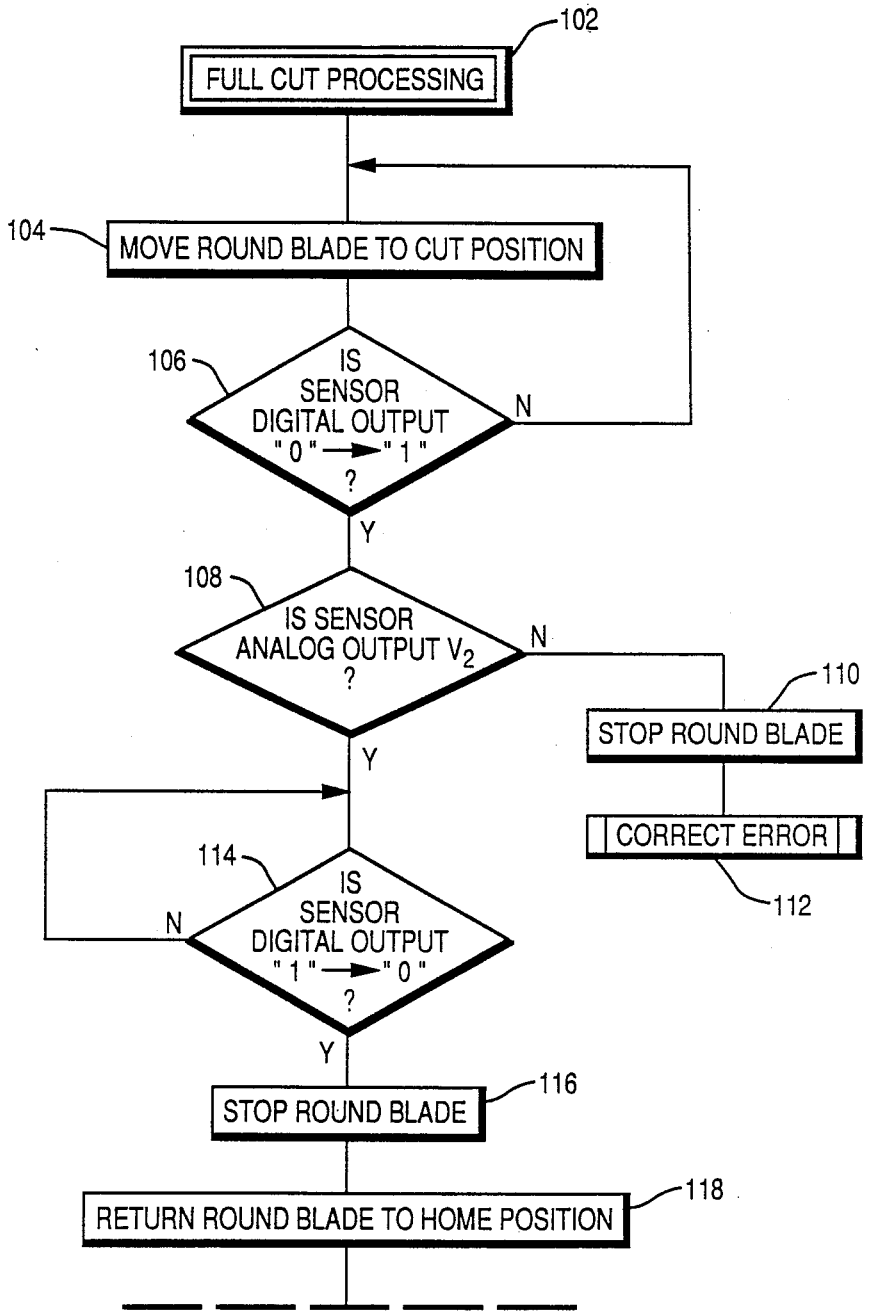
Figure 9B:
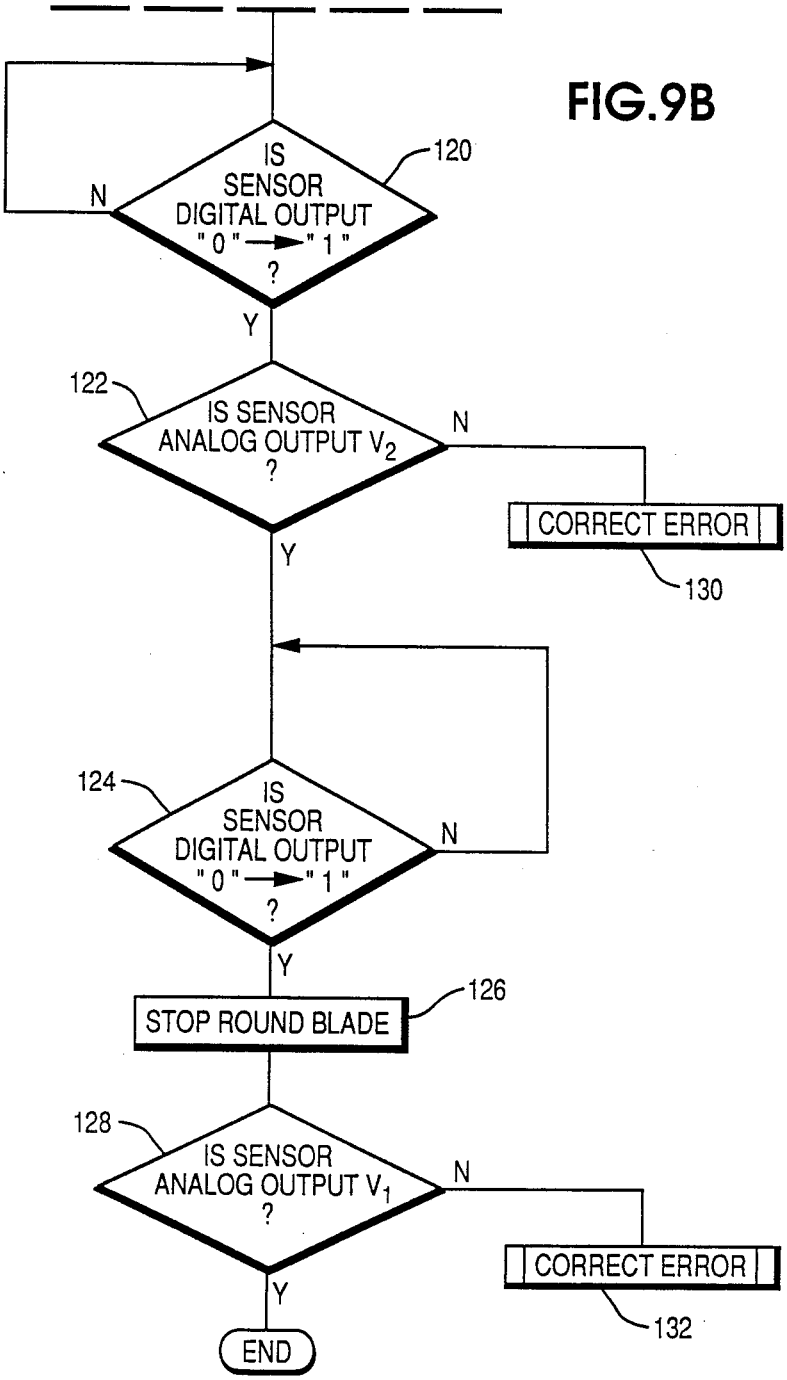

FIGS. 9A and 9B show the steps of a full cut processing, as started at block 102, and wherein the cutting blade 74 is moved from home position $L_1$ to the read end position, as indicated at location $L_3$ in FIG. 6A. The operation is that of moving the cutting blade 74 from the home position to the cutting position (block 104) to fully cut the receipt paper 24 (FIG. 5). During the time that the cutting blade 74 is being moved to the full cut position, the receipt paper 24 is being cut and during such time the sensor digital output changes in the order of "1" to "0" to "1".

When the sensor digital output changes for the first time from "0" to "1" (block 106), the process is checked to see whether or not the sensor analog output is $V_2$ (block 108). If the sensor analog output is not $V_2$, the operation is in error and the movement of the cutting blade 74 is stopped to correct the error in operation (blocks 110 and 112). If the sensor analog output is $V_2$, the process continues to block 114. When the sensor digital output changes from "1" to "0" (block 114), the cutting blade 74 is stopped (block 116) indicating that the receipt paper 24 is fully cut. The cutting blade 74 is then returned to the home position (block 118).

After the cutting blade 74 has returned to the home position (block 118), the changing of the sensor digital output from "0" to "1" (block 120) indicates that the cutting blade 74 is in the $L_3$ location or full cut position (FIG. 6A). The process of cutting blade 74 movement is then checked to see whether or not the sensor analog output is $V_2$ (block 122). If the sensor analog output is not $V_2$, the operation is in error and is stopped to correct the error (block 130). If the sensor analog output is $V_2$, the process continues to block 124. When the sensor digital output changes from "1" to "0", the cutting blade 74 is in the $L_2$ location or partial cut position (FIG. 6A). When the sensor digital output changes from "0" to "1", the cutting blade 74 is at the home position (block 124), and operation of the blade 74 is stopped (block 126). If the sensor digital output does not change from "0" to "1", the process continues in a loop until such change occurs. The process is then checked to confirm that the sensor analog output is $V_1$ (block 128) which is the indication of completion of the paper cutting operation. In the course of going through the various steps of the process in the full cut operation, if the sensor analog output is not $V_2$ (block 122) or if the sensor analog output is not $V_1$ (block 128), operations are performed to correct the error (blocks 130 and 132).

Figure 10:
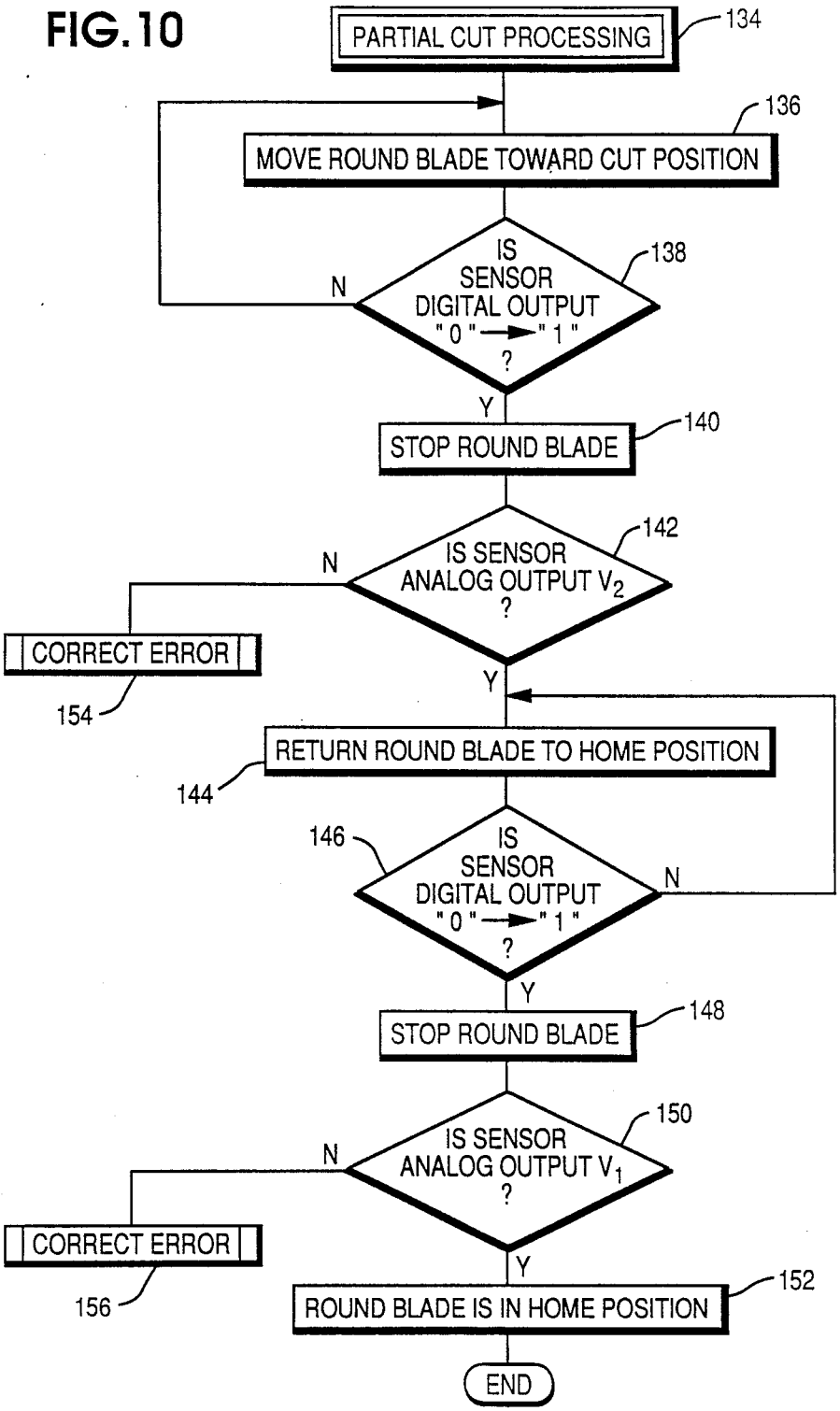

FIG. 10 shows the steps of a partial cut processing, as started at block 134, and wherein the cutting blade 74 is moved from home position $L_1$ to read end position, indicated at location $L_2$, for the partial cutting operation. As in the case of the full cut operation, after the completion of the partial cut, the cutting blade 74 is returned to the home position. The movement of the cutting blade 74 is started (block 136) toward the partial cut position. When the sensor digital output changes from "0" to "1" (block 138), the movement of the cutting blade 74 is stopped (block 140) and the process is checked to see whether or not the sensor analog output is $V_2$ (block 142). If the sensor analog output is $V_2$, the blade 74 is returned to the home position (block 144).

When the sensor digital output changes from "0" to "1" (block 146), operation of the cutting blade 74 is stopped (block 148). The process is then checked to confirm that the sensor analog output is $V_1$ (block 150) and, if so, the cutting blade 74 is in the home position (block 152). In the course of going through the various steps of the process in the partial cut operation, if the sensor analog output is not $V_2$ (block 142), or if the sensor analog output is not $V_1$ (block 150), operations are performed to correct the error (blocks 154 and 156), in similar manner as indicated by blocks 130 and 132 in FIG. 9B for the full cut operation.

Figure 11:
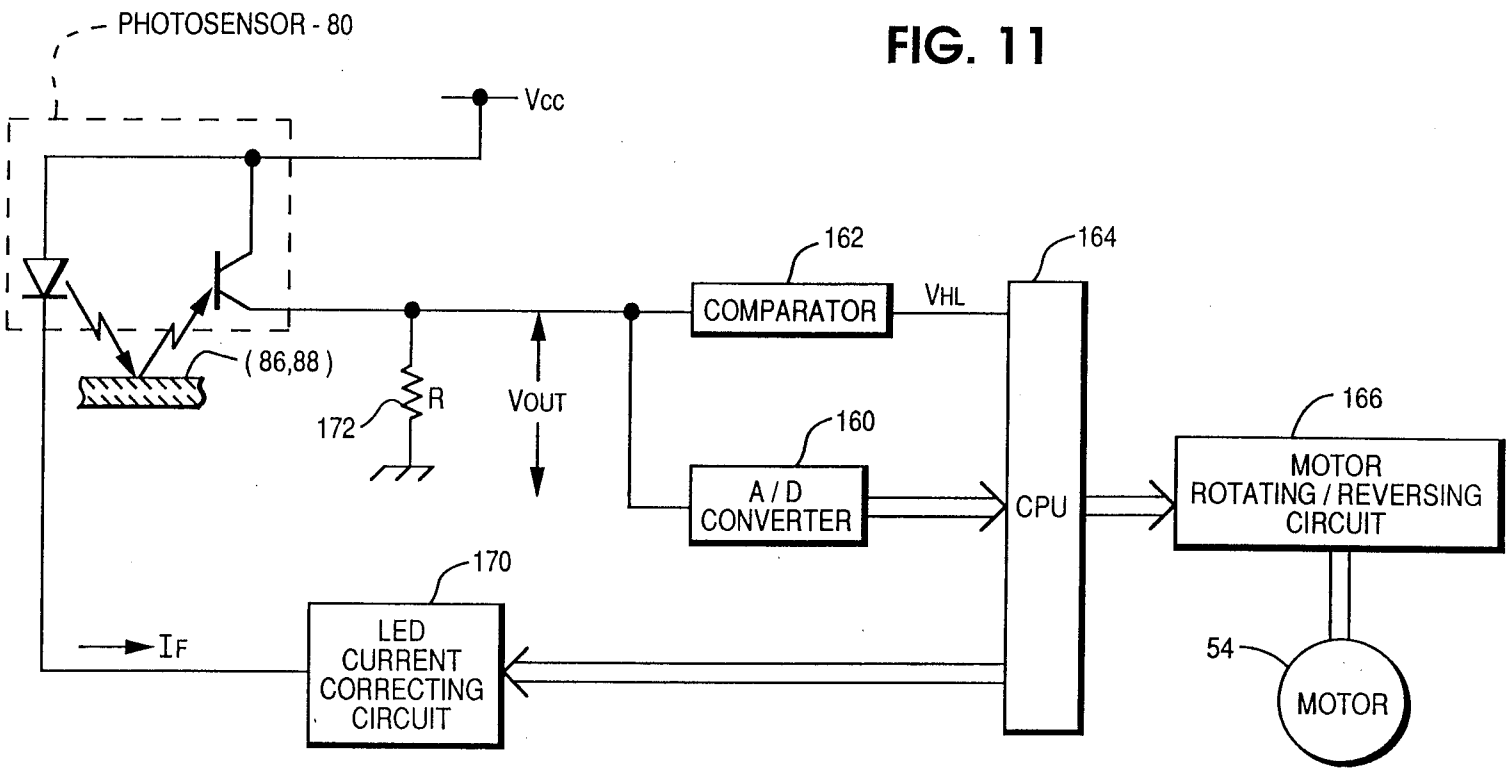
FIG. 11 is a diagram of the control circuit for the cutting mechanism.

FIG. 11 shows an arrangement of the control circuit for the drive mechanism for the cutting blade 74. The reflex type photosensor 80 is carried on the carriage 52 for the cutting blade 74. The photosensor 80 generates a sensor analog output $V_{OUT}$ in accordance with a difference in the amount of reflected light from the surface or face 86 of reflective plate 82 or from the surface or face 88 of reflective plate 84. The sensor analog output $V_{OUT}$ is sent to an analog-to-digital converter 160 which determines whether such output is of the magnitude $V_1$ or $V_2$. The output $V_{OUT}$ from the photosensor 80 is also sent to a comparator 162. The output of comparator 162 is used as an interruption signal, designated as $V_{HL}$, to a central processing unit (CPU) 164 which includes the programs of the steps of operation shown in FIGS. 8, 9A, 9B and 10 The signal $V_{HL}$ is shown as being and can be either a low output voltage $V_L$ or a high output voltage $V_H$, as indicated in FIG. 6C. A motor rotating/reversing circuit 166 is controlled by the central processing unit 164 for operating the motor 54. A light emitting diode current correcting circuit 170 is connected to the CPU 164 and to the photosensor 80 which detects signals from reflecting face 86 or 88. A resistor 172 is connected to the output of the photosensor 80 and to ground.

Figure 12:
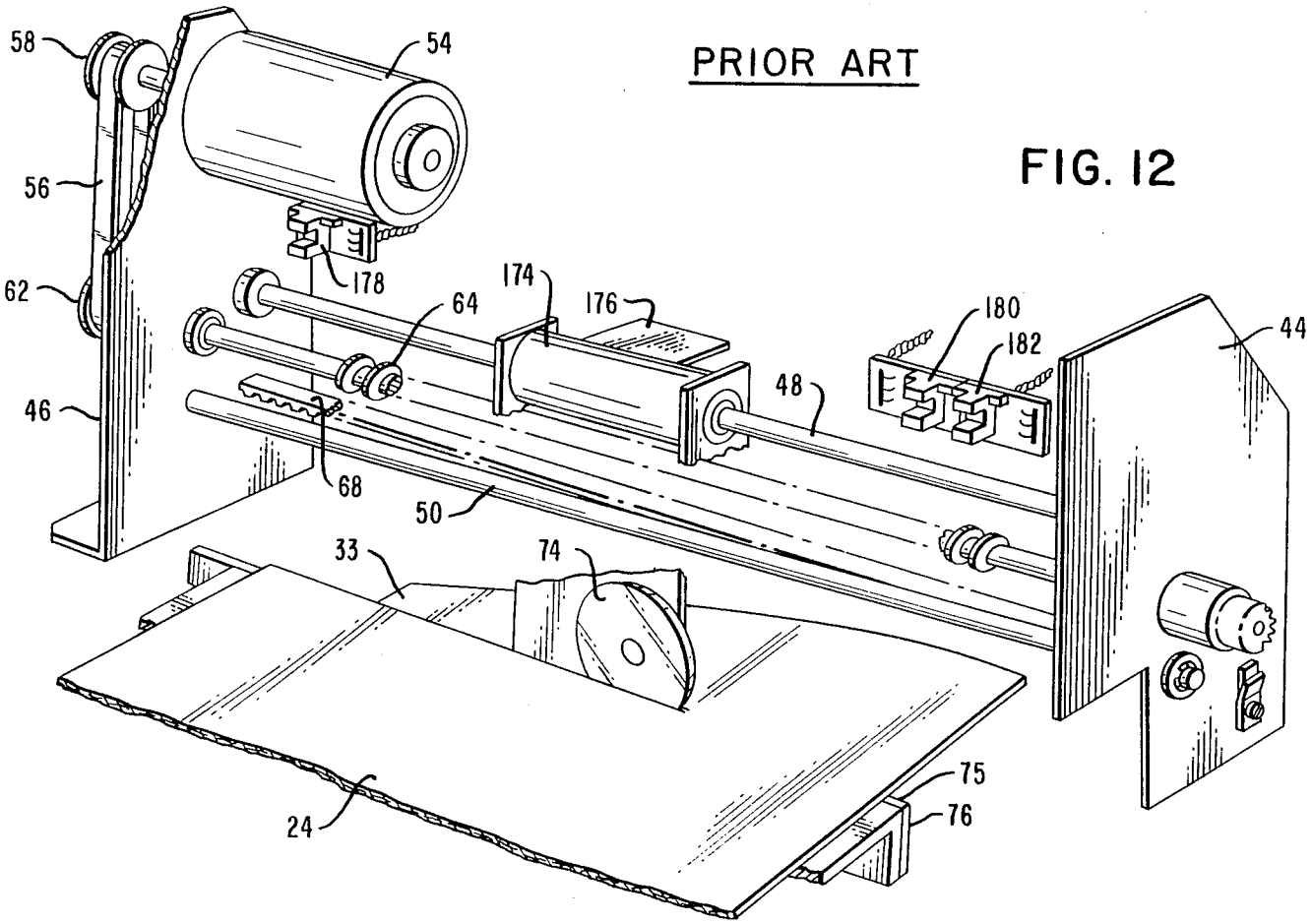
FIG. 12 PRIOR ART
FIG. 12 is a perspective view showing an arrangement of sensors and a reflecting element of a conventional printer.

FIG. 12 shows an arrangement of a cutting mechanism in a conventional printer which used some of the same parts as described above. The motor 54 drives a carriage 174 by means of the belt 56 and the lead screw 64. The cutting blade 74 is carried by the carrier 174 and cooperates with the fixed blade 76 for cutting the receipt paper 24 and providing a receipt 33. The carriage 174 has a light shielding plate 176 attached thereto which is operable with a plurality of light transmission type photosensors 178, 180 and 182. The light transmission type photosensors 178, 180 and 182 each include a light emitting element and a light receiving element which is positioned in facing relationship with the light emitting element. The photosensors 178, 180 and 182 are located in the home position and in the paper cutting position, the latter position being disposed at the end of the paper cutting operation. The light shielding plate 176 is provided on the carriage 174 for shielding the light of the respective photosensor 178, 180 or 182. The position of the carriage 174 is sensed in the manner of presence or absence of an output from the respective photosensor 178, 180 or 182 for controlling the movement of the cutting blade 74.

The photosensor 178 is located at the home position, the photosensor 180 is located at the partial cut position and the photosensor 182 is located at the full cut position of the cutting mechanism. It is thus seen that at least two photosensors, 178 and 180 or 178 and 182, are required to provide a cutting operation for either a partial cut or a full cut of the receipt paper 33. If both a partial cut and a full cut are desired, the operation requires all three photosensors 178, 180 and 182. In this regard and using the cutting mechanism in a conventional printer, the number of components is increased and the manufacturing and assembling steps are complicated so that a reduction in cost cannot be attained.

In the operation of the present invention, it is seen that when the cutting blade 74 is in the home position or location $L_1$, the photosensor 80 on the carriage 52 receives a lower level or lesser amount of light from the reflective plate 82 by reason of the longer distance $d_1$ from the photosensor 80 to the face of the reflective plate 82. The control apparatus and circuitry recognizes that the cutting blade 74 is currently in the home position by reason of the lesser light-lower output voltage signal. When the cutting blade 74 is in the cutting position, the photosensor 80 receives a higher level or greater amount of light from the reflective plate 84 due to the shorter distance from the photosensor 80 to the face of the reflective plate 84. The control apparatus and circuitry recognize that the cutting blade 74 is currently in the cutting position by reason of the greater light-higher output voltage signal. The result of this arrangement is that the operation of the cutting blade 74 is controlled by the single photosensor 80.

The present invention provides the single light reflecting photosensor 80 secured on the carriage 52 of the cutting blade 74. The light reflecting plates 82 and 84 are located in home and cutting positions and are at different distances from the photosensor 80 to enable sensing of the current position of the cutting blade 74 by a single photosensor for accurately controlling the movement and operation of the cutting blade. As a result of this arrangement, the number of components can be reduced, the assembling operation can be facilitated and the manufacturing cost can be reduced.

It is thus seen that herein shown and described is a compact dot matrix printer that includes control apparatus for a receipt cutting mechanism, wherein the cutting blade is caused to be rotated by the external driving force that is used to move the cutting blade carriage across the printer. The control apparatus includes a single photosensor element operating with one reflective plate at one distance therefrom for indicating the home position of the cutting blade and operating with another reflective plate at a different distance from the photosensor for indicating the cutting position of the cutting blade. The apparatus and arrangement enable the accomplishment of the objects and advantages mentioned above, and while the preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. A control mechanism in a printer having a carriage and a rotatable cutting blade secured thereto for cutting record media, said control mechanism comprising drive means for moving said carriage and said rotatable cutting blade across said printer, a photosensor secured to said carriage and having a light emitting element and a light receiving element, a first reflecting member at one location facing said photosensor and spaced therefrom at a predetermined first distance, a second reflecting member at another location facing said photosensor and spaced therefrom at a predetermined second distance, means for sensing a difference in the strength of light received by said light receiving element at one location after emitting of light and reflecting thereof by said first reflecting member at said one location from the strength of light received by said light receiving element ar another location after emitting of light and reflecting thereof by said second reflecting member at said another location, and means responsive to voltage signals generated by the difference in strengths of light for controlling the operation of the drive means and of the rotatable cutting blade for cutting said record media.

2. The control mechanism of claim 1 wherein said drive means includes a lead screw coupled to said carriage for moving thereof across the printer.

3. The control mechanism of claim 1 wherein said printer includes a fixed blade engageable by said rotatable cutting blade for cutting said record media.

4. The control mechanism of claim 1 wherein said first reflecting member is a plate located at a home position of said carriage.

5. The control mechanism of claim 1 wherein said second reflecting member is a plate located at a record media cut position of said carriage.

6. The control mechanism of claim 1 wherein said first reflecting member is a plate having an edge sensed by said photosensor and indicating home position of said carriage and wherein said second reflecting member is a plate having a first edge sensed by said photosensor and indicating a record media partial cut position of said rotatable cutting blade and said carriage and having a second edge sensed by said photosensor and indicating a record media full cut position of said rotatable cutting blade and said carriage.

7. In a printer having a fixed blade, a carriage carrying a rotatable cutting blade cooperating with said fixed blade for cutting record media, and means for moving the carriage across the printer, the improvement comprising photosensing means carried on said carriage and having a light emitting element and a light receiving element, a first reflecting member at a first location facing said photosensing means and spaced therefrom at a predetermined first distance, a second reflecting member at a second location facing said photosensing means and spaced therefrom at a predetermined second distance, means for sensing a difference in the strength of light received by said light receiving element of said photosensing means at said first location after emitting of light and reflecting thereof by said first reflecting member at said first location from the strength of light received by said light receiving element at said second location after emitting of light and reflecting thereof by said second reflecting member at said second location, and control means responsive to voltage signals generated by the difference in the strengths of light as sensed by said photosensing means for controlling the operation of the means for moving the carriage and the rotatable cutting blade across the printer in record media cutting operation.

8. In the printer of claim 7 wherein said first reflecting member is a plate located at a home position of said carriage.

9. In the printer of claim 7 wherein, said second reflecting member is a plate located at a record media cut position of said carriage.

10. In the printer of claim 7 wherein said predetermined first distance and said predetermined second distance are different.

11. In the printer of claim 7 wherein said control means includes a comparator and an analog-to-digital converter responsive to said output voltage signals, and a central processing unit for receiving output signals from said comparator and from said converter for controlling the operation of the means for moving the cutting blade across the printer.

12. In the printer of claim 7 wherein said first reflecting member is a plate having an edge sensed by said photosensing means and indicating home position of said carriage and wherein said second reflecting member is a plate having a first edge sensed by said photosensing means and indicating a record media partial cut position of said rotatable cutting blade and having a second edge sensed by said photosensing means and indicating a record media full cut position of said rotatable cutting blade.

13. In the printer of claim 7 wherein said control means includes a comparator and an analog-to-digital converter responsive to said generated voltage signals output by said photosensing means, a central processing unit for receiving output signals from said comparator dependent upon the strength of light at two levels of voltage output signals and a motor control circuit responsive to the output of said central processing unit for controlling the movement of said cutting blade across the printer.

* * * * *